United States Patent [19]

Smith et al.

[11] 4,304,372

[45] Dec. 8, 1981

[54] WATER-SKI TOWLINE WINCH ASSEMBLY

[76] Inventors: Richard E. Smith, 500 Fair St., Petaluma, Calif. 94952; William L. Bryant, 273 Carina Dr., Santa Rosa, Calif. 95401

[21] Appl. No.: 95,603

[22] Filed: Nov. 19, 1979

Related U.S. Application Data

[63] Continuation-in-part of Ser. No. 944,855, Sep. 22, 1978, abandoned.

[51] Int. Cl.[3] ..... B65H 75/34; B65H 75/44

[52] U.S. Cl. ..... 242/86.5 A; 242/106; 242/117; 254/346; 254/380; 114/254

[58] Field of Search ..... 242/86.5 A, 85.1, 96, 242/100, 106, 125.2, 211, 117, 77, 77.3, 84.8, 84.2 J, 84.1 L; 254/346, 323, 380, 262; 43/20, 21, 43.11, 44.9, 44.91, 54.5 R, 54.5 A; 9/8 R, 9; 114/326, 254

[56] References Cited

U.S. PATENT DOCUMENTS

| | | | |
|---|---|---|---|
| 572,973 | 12/1896 | Ennes | 254/346 |
| 2,555,671 | 6/1951 | Baia | 242/106 X |
| 2,998,796 | 9/1961 | Wittrock | 242/86.5 A |
| 3,010,673 | 11/1961 | Marconi | 242/85.1 |
| 3,162,395 | 12/1964 | Bray | 242/86.5 A |
| 3,438,595 | 4/1969 | Brown et al. | 242/96 |
| 3,498,563 | 3/1970 | Palmieri | 242/86.5 A |
| 3,638,876 | 2/1972 | Bullock | 242/86.5 A X |
| 3,831,545 | 8/1974 | Cain | 242/86.5 A X |
| 4,091,559 | 5/1978 | Easley | 242/106 X |

FOREIGN PATENT DOCUMENTS

| | | | |
|---|---|---|---|
| 1236428 | 6/1960 | France | 43/54.5 A |

*Primary Examiner*—John M. Jillions
*Attorney, Agent, or Firm*—Phillips, Moore, Weissenberger, Lempio & Majestic

[57] ABSTRACT

A water-ski towline winch assembly comprises a support member adapted to be mounted on a boat and an annular drum rotatably mounted on the support member. A handle is rotatably mounted on the support member to rotate the drum to selectively reel-in or reel-out the towline, via a stepped-down gear set. A plurality of slots are formed in the drum whereby floats secured on the towline may be positioned exteriorly of the drum in non-interfering relationship with the towline which is wrapped on the drum. A release mechanism is provided for permitting the gear set to free-wheel to troll out the towline. Two embodiments of the invention are disclosed herein with one of the embodiments (FIGS. 7–11) including a mounting bracket for vertical or horizontal securance to the hull of the boat and a support bracket attachable to the mounting bracket and having the winch assembly proper mounted thereon.

18 Claims, 11 Drawing Figures

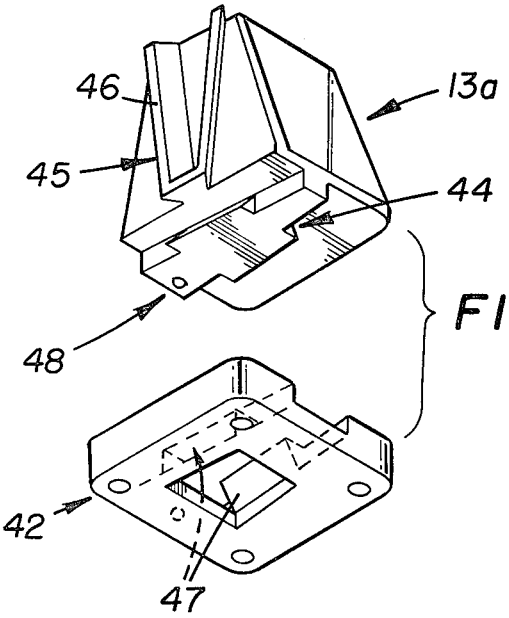
FIGURE 10
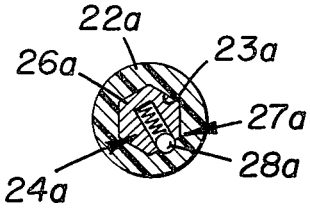
FIGURE 8
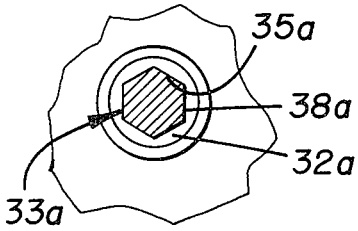
FIGURE 9
FIGURE 11
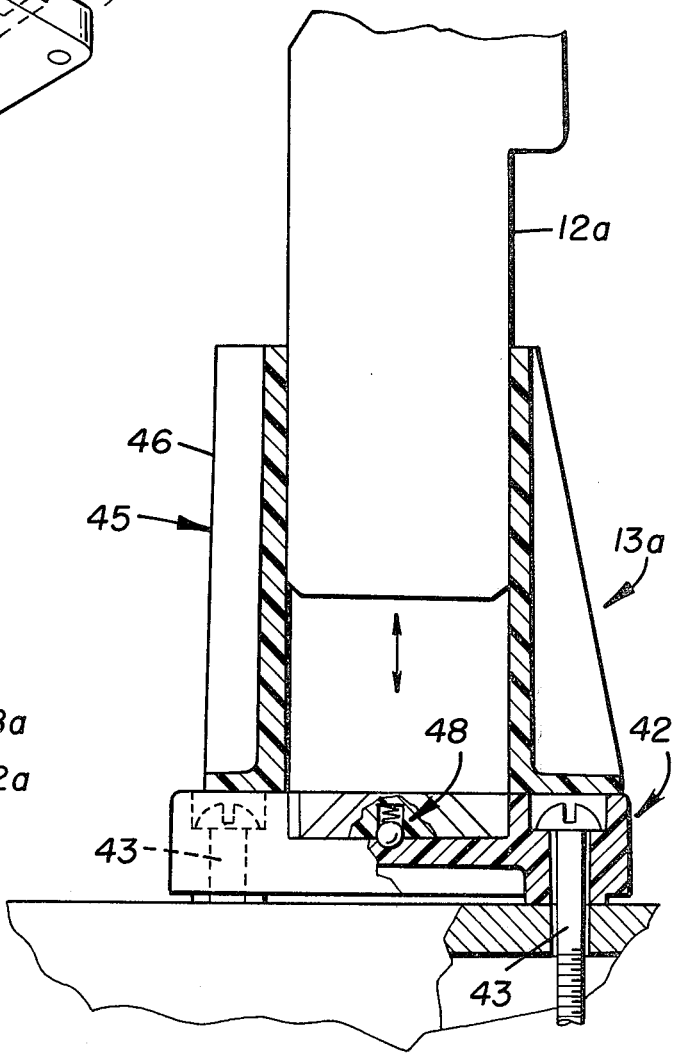

WATER-SKI TOWLINE WINCH ASSEMBLY

CROSS-REFERENCE TO RELATED APPLICATION

This application is a continuation-in-part of U.S. application Ser. No. 944,855, filed on Sept. 22, 1978 for "Water-Ski Towline Winch Assembly," now abandoned.

BACKGROUND OF THE INVENTION

The popularity of water-skiing dictates the need for a device for reeling-in a towline upon release thereof by a water-skier. It is standard practice to normally pull in the towline hand-over-hand, which normally results in the entanglement of the towline. Anyone who has encountered this problem will appreciate that substantial time is required to untangle the towline to condition it for use by another water-skier. It should be further obvious that considerable time is required to pull the towline into a boat.

One attempt to solving the above problems has been the provision of a holder which is held by a person in the boat who then proceeds to manually wrap the towline on the holder. This procedure is also time consuming and oftentimes results in entanglement of the towline. Furthermore, the unwrapping of the towline for placement in the water for use by a water-skier is also time consuming.

Manually actuated, gear driven apparatus have also been proposed for reeling-in or reeling-out the towline. Such apparatus are oftentimes unduly complex and do not provide for the efficient storage of the towline on a rotary drum thereof, nor do they provide for the quick-release of the drum for permitting free-wheeling thereof, during the reeling-out mode of operation. In addition, the mounting bracket for such apparatus are constructed for securing the apparatus at only one set location on a hull of a boat.

SUMMARY OF THE INVENTION

An object of this invention is to overcome the above, briefly described problems by providing a water-ski towline winch assembly which is adapted to reel-in and reel-out a towline expeditiously without causing entanglement thereof.

The winch assembly comprises a support member having mounting means thereon for mounting the winch assembly on a boat. An annular drum is rotatably mounted on the support member and has attachment means secured thereon for attaching a hook of the towline thereto. A drive means is provided for selectively rotating the drum in either direction to reel-in or reel-out the towline expeditiously.

In the preferred embodiment of this invention, at least one slot is formed in the drum to have the towline inserted therein to position floats attached to the towline exteriorly of the drum and in non-interfering relationship with the towline which is wrapped on the drum. In addition, the winch assembly preferably comprises a quick-release mechanism, connectible with a drive shaft of the drive means, for effecting the reel-out mode of operation. Also, in one embodiment of the present invention the winch assembly proper is mounted on a support bracket which is, in turn, attachable on a mounting bracket adapted to be secured at different orientations on a boat hull.

BRIEF DESCRIPTION OF THE DRAWINGS

Other objects of this invention will become apparent from the following description and accompanying drawings wherein:

FIGS. 8 and 9 are sectional views, taken in the direction of arrows VIII—VIII and IX—IX, respectively, in FIG. 7;

FIG. 10 is an exploded, isometric view illustrating mounting and support brackets for the FIGS. 6–9 winch assembly; and FIG. 11 is an enlarged, sectional view illustrating mounting of the winch assembly on the support bracket and attachment of the support bracket on the mounting bracket.

DETAILED DESCRIPTION

Figure 1:
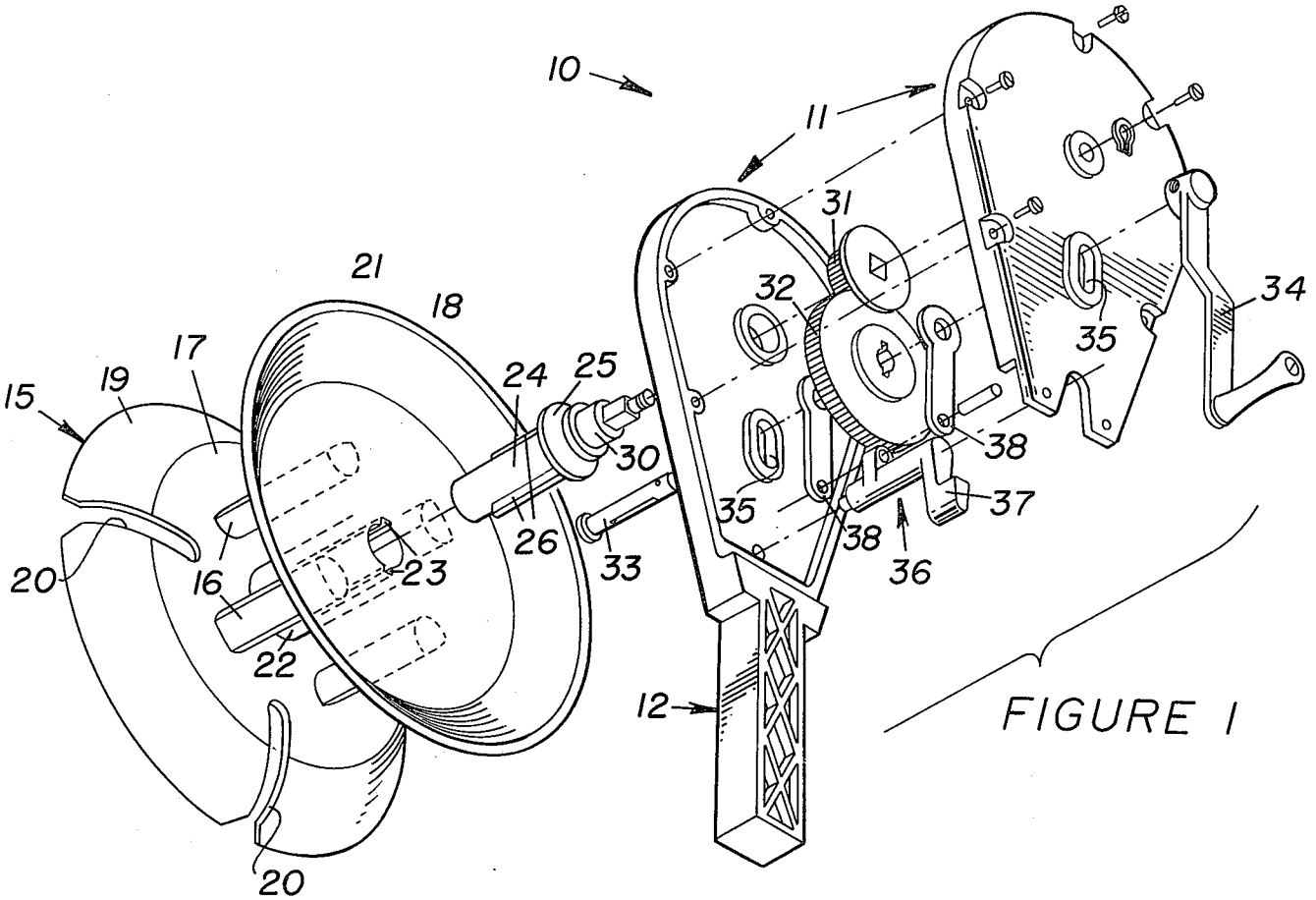
FIG. 1 is an exploded isometric view of a water-ski towline winch assembly embodying this invention.

FIG. 1 illustrates a winch assembly 10 comprising a support member 11 having a mounting means 12 secured thereon for mounting the winch assembly on a boat. Briefly referring to FIG. 2, a channel 13, preferably having a square cross section, is suitably secured interiorly on a hull 14 of a boat to releasably receive mounting means 12, which is shown in the form of a stem also having a square cross section to be accomodated within channel 13. Channel 13 may be suitably secured to the stern, port side, starboard side, or other suitable location on the boat, as desired. The square cross sections of mounting means 12 and channel 13 will, of course, permit the mounting means of winch 10 to be inserted in channel 13 in one of four positions, oriented 90° one from another.

Figure 2:
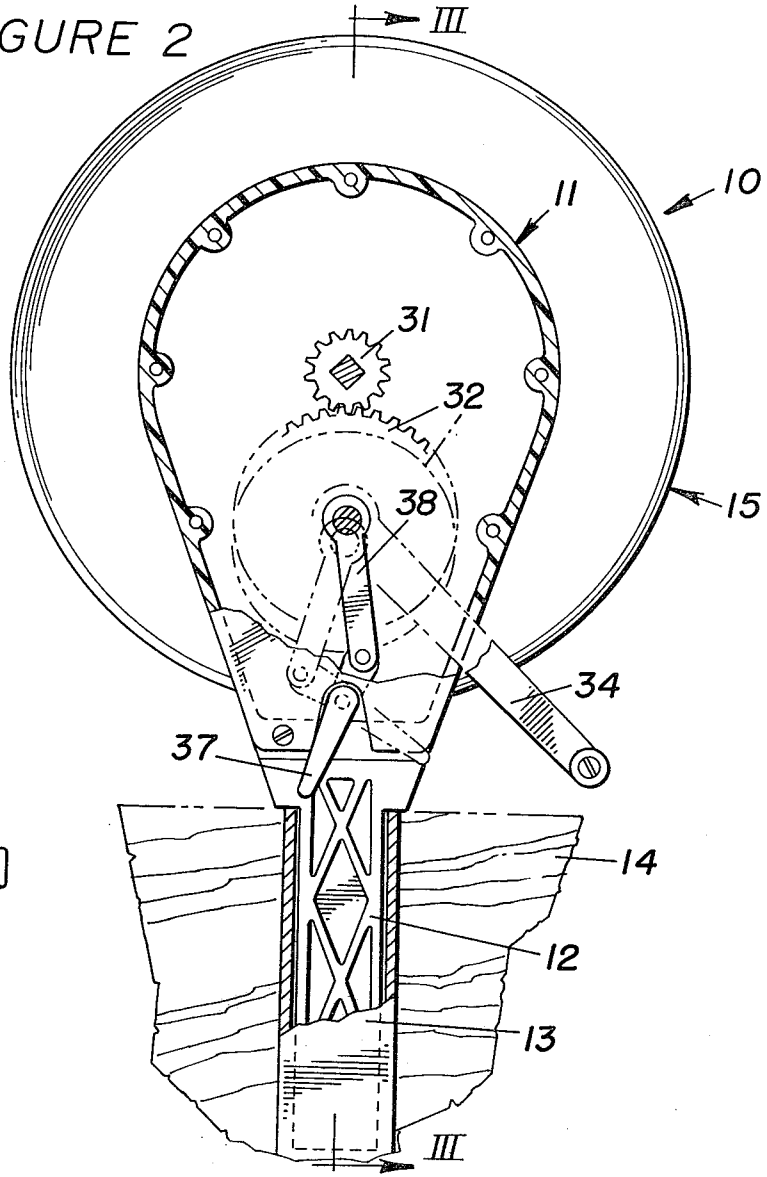
FIG. 2 is a partially sectioned, side elevational view of the winch assembly shown mounted on a boat.
Figure 4:
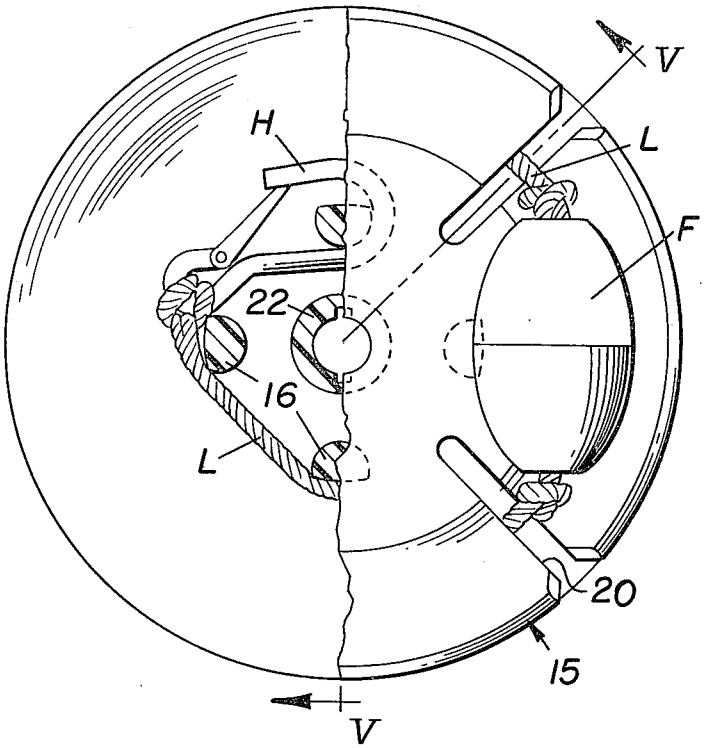
FIG. 4 is a partially sectioned, side elevational view of the winch assembly, showing a snap hook of a water-ski towline attached on a drum thereof.
Figure 6:
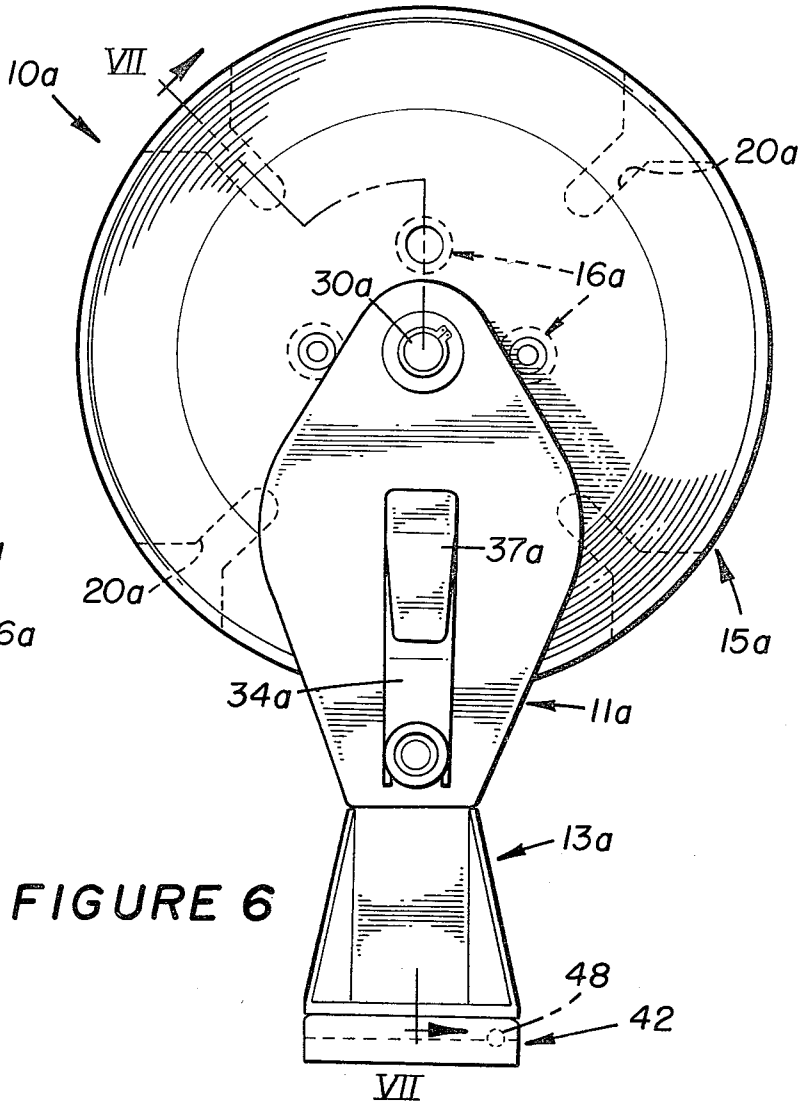
FIG. 6 is a side elevational view of a modified winch assembly.
Figure 7:
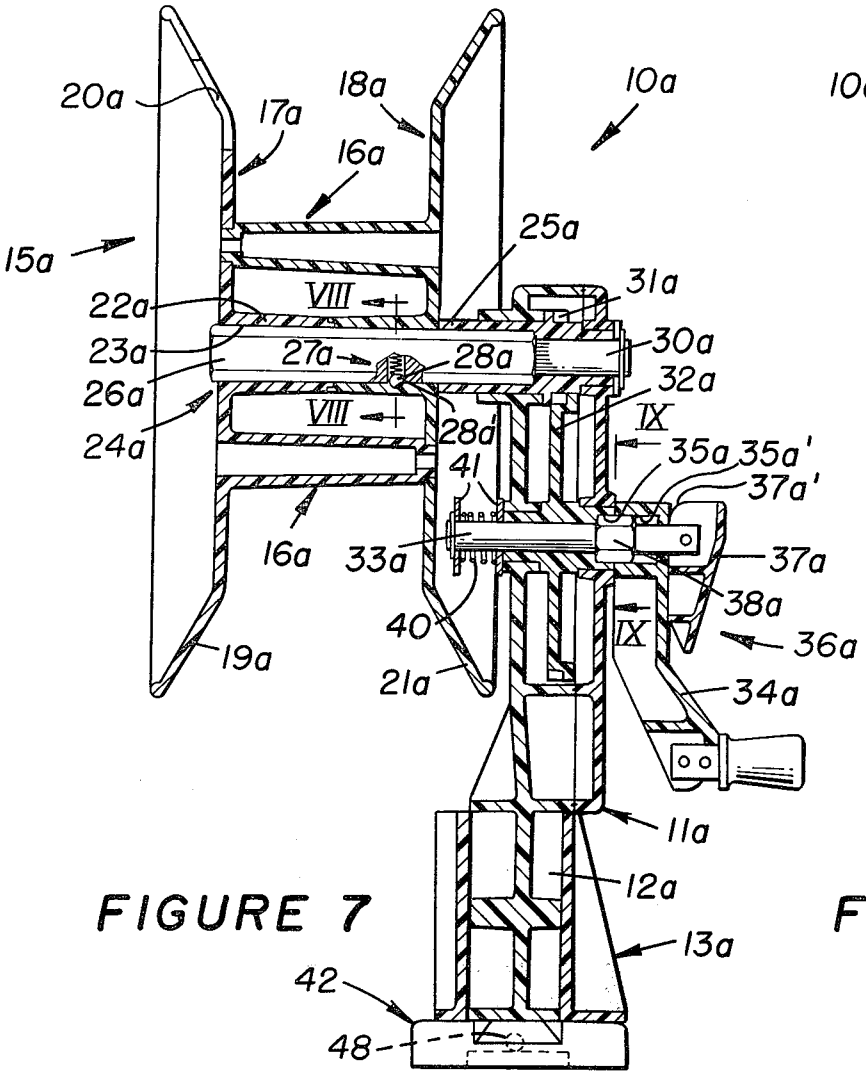
FIG. 7 is a sectional view, taken in the direction of arrows VII—VII in FIG. 6.

Referring to FIGS. 1, 2 and 4, an annular drum 15 is rotatably mounted on support member 11 to selectively reel-in or reel-out a water-ski towline L upon attachment of a snap hook H thereto. Attachment means in the form of a plurality of circumferentially spaced cross-struts 16, secured between a pair of annular plates 17 and 18 of the drum, are adapted to releasably connect hook H to the drum. First plate 17 has a flared flange 19 secured on the periphery thereof to extend outwardly from the drum. A plurality of radial slots 20 are formed through plate 17 and flange 19 for purposes hereinafter more fully explained. Although four such equally spaced slots are formed in plate 17, it should be noted that any desired number of such slots could be employed.

Second plate 18 also has a flared flange 21 formed thereon to cooperate with flange 19 to provide guide means on the drum for aiding in the reeling-in of towline L. A sleeve 22 is formed integrally with and extends between plates 17 and 18 and has a pair of diametrically opposed keyways 23 formed therein. As more clearly shown in FIGS. 3 and 5, the above-described drum is adapted to be releasably mounted on an output shaft 24 having a positioning disc 25 thereon.

Figure 3:
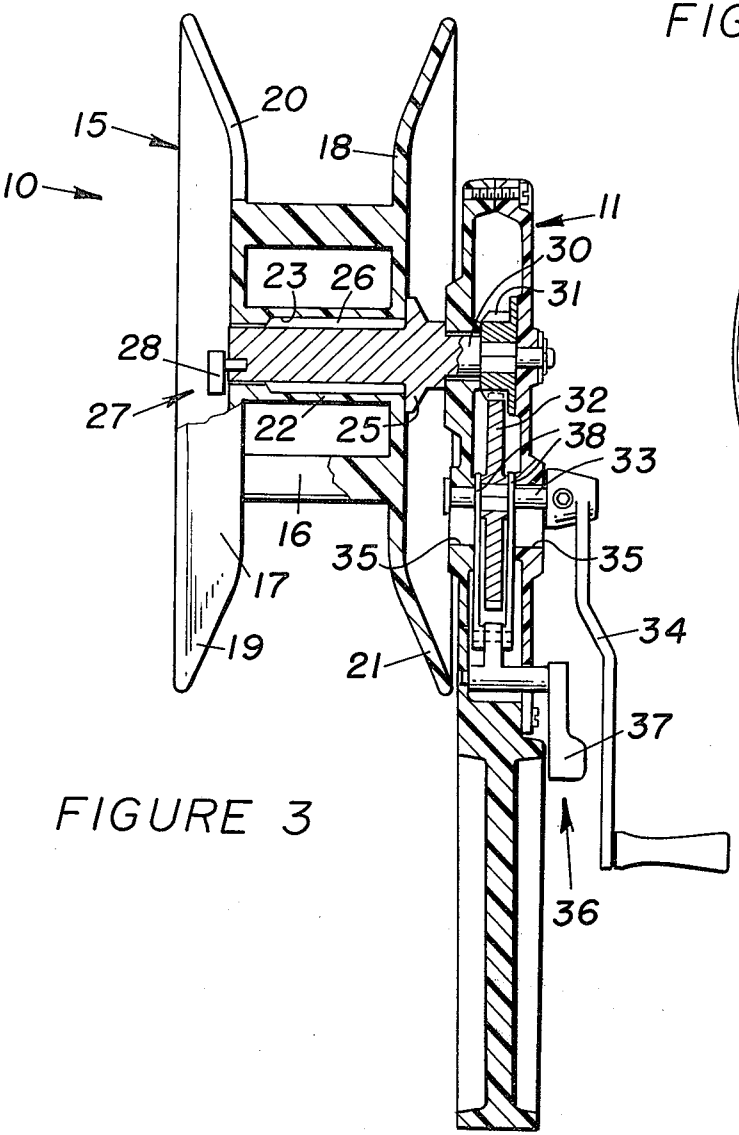
FIG. 3 is a sectional view of the winch assembly, taken in the direction of arrows III—III in FIG. 2.

A pair of diametrically opposed keys 26 are formed externally on shaft 24 to engage keyways 23 to prevent relative rotation between sleeve 22 and shaft 24. As shown in FIG. 3, a standard latch means 27 may comprise a latch member 28 pivotally mounted on shaft 24 to engage an outer side of plate 17 of drum 15. Thus, the latch means will prevent axial outward movement of drum 15 relative to shaft 24 whereas keyways 23 and keys 26 will prevent relative rotation therebetween.

A shaft 30 is rotatably mounted on support member 11 and forms an extension of shaft 24, i.e., shafts 24 and 30, disc 25, and keys 26 are preferably formed as one piece. A drive means for selectively rotating the shaft and thus drum 15 comprises shaft 24, a first pinion gear 31 secured to shaft 30, and a second pinion gear 32 secured to a second shaft 33, also rotatably mounted on support member 11. It should be noted that support member 11 constitutes a two-part housing, enclosing the stepped-down gear set comprising pinion gears 31 and 32 which may exhibit a stepped-down gear ratio of 3:1, for example.

A handle 34 is suitably secured to shaft 33 to selectively rotate the same in either direction. Shaft 33 is preferably mounted in lost motion slots 35, formed in spaced walls of support member 11. A drive disengaging means 36 comprises a lever 37 pivotally mounted on support member 11 and a pair of links 38 pivotally mounted on the lever and further pivotally mounted on shaft 33 to straddle gear 32. As shown in FIG. 2, upon counterclockwise rotation of lever 37 to its phantom-lined position, shaft 33 and thus gear 32 will move downwardly whereby gear 32 disengages from gear 31. Such gear disengagement may be employed, for example, to reel-out towline L (FIG. 1) from the boat expeditiously.

Figure 5:
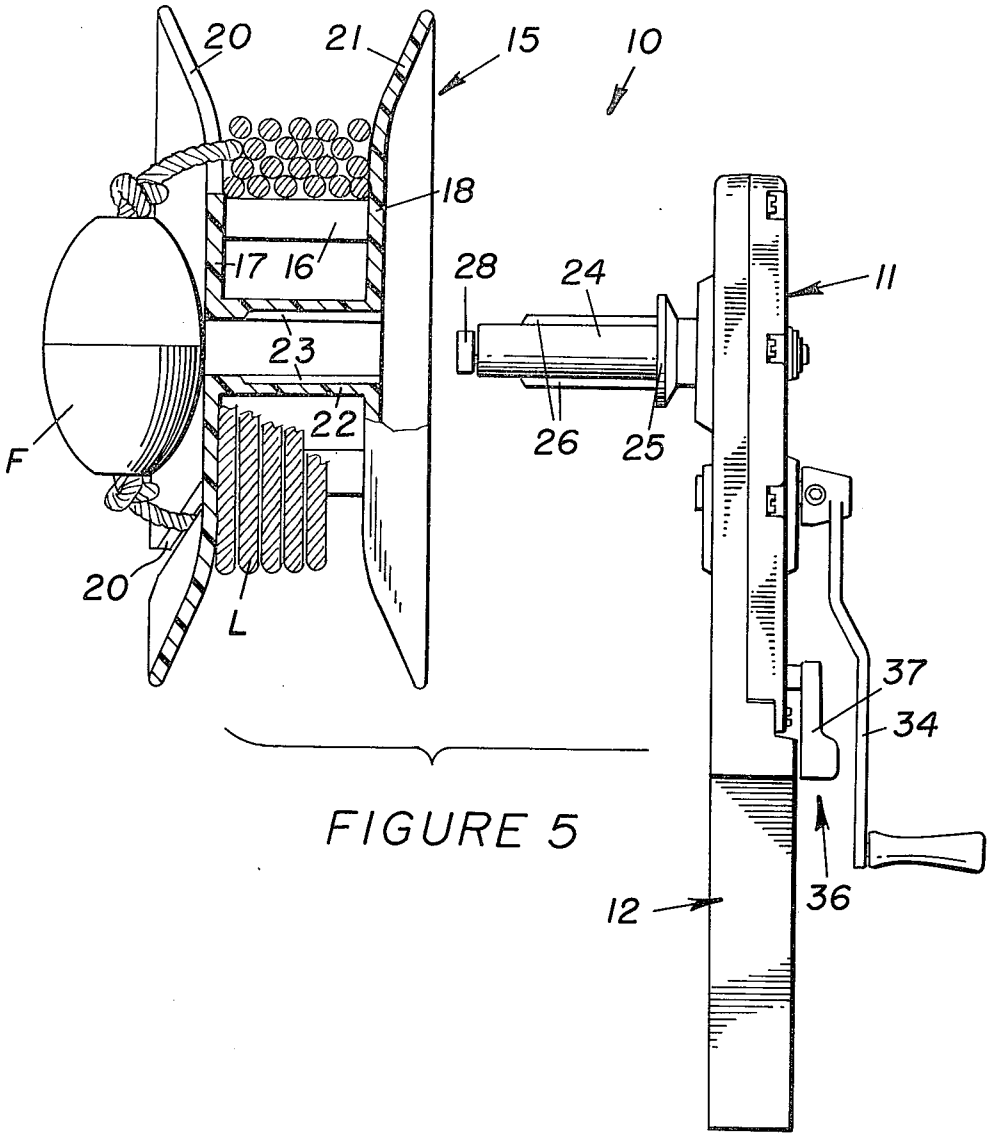
FIG. 5 is a view, taken in the direction of arrows V—V in FIG. 4, showing the drum removed from a mounting shaft of the winch assembly.

Referring now to FIGS. 4 and 5, upon reeling-in of towline L, it is desirable to store floats F (FIG. 1) exteriorly of drum 15 so that the floats do not interfere with the wrapping of the towline on struts 16 of the drum. Slots 20 will accomodate such disposition of the floats by permitting the towline to be inserted therein whereby each float may be stored in protected relationship within flared flange 19 of the drum.

In the preferred embodiment of this invention, the component parts of the winch assembly are preferably composed of a suitable non-corrosive material, such as plastic or aluminum, which will exhibit the desired structural integrity required for the loads imposed on the winch assembly during operation thereof. It should be further noted that subsequent to the reeling-in of one towline that latch means 37 (FIGS. 3 and 5) can be released to permit removal of drum 15 and the wrapped towline from shaft 24. The removed drum may then be replaced by an empty drum to reel-in another towline with the operation being repeated as many times as desired, taking into account the availability of the required number of empty drums.

FIGS. 6–11 illustrate a second winch assembly embodiment 10*a* comprising a support member 11*a* having a mounting means or stem 12*a* secured thereon for mounting the winch assembly on a support bracket 13*a*, as described more fully hereinafter. Winch assembly 10*a* comprises an annular drum 15*a*, rotatably mounted on support member 11*a*, to selectively reel-in or reel-out a water-ski towline.

Attachment means in the form of a plurality of circumferentially spaced cross-struts 16*a*, secured between a pair of annular plates 17*a* and 18*a* of the drum, are adapted to releasably connect a hook of the towline to the drum. Plate 17*a* has a flared flange 19*a* secured thereon to extend outwardly from the drum and a plurality of radial slots 20*a* are formed through the plate and flange for float storing purposes. Plate 18*a* also has a flared flange 21*a* formed thereon to cooperate with flange 19*a* to provide guide means on the drum for aiding in the reeling-in of the towline.

A tubular sleeve 22*a* extends between the plates and has a hexagonal keyway 23*a* (FIG. 8) formed therethrough. An output drive shaft 24*a*, also having a hexagonal cross-section, is disposed in slip-fit relationship within keyway 23 to rotate drum 15*a* in response to rotation of the shaft. A detent means 27*a* includes a spring-biased detent or ball 28*a* (FIGS. 7 and 8) which engages a recess 28*a*', formed on sleeve 22*a*, to releasably lock the drum in position on the drive shaft.

A sleeve 25*a*, also keyed on shaft 24*a* by an hexagonal keyway formed therein to mate with shaft 24*a*, abuts an outer side of plate 18*a* to properly position the drum on the shaft and to properly locate ball 28*a* of detent means 27*a* for locking purposes. An extension 30*a* of shaft 24*a* has a pinion gear 31*a*, formed on sleeve 25*a*, disposed thereon to engage a second pinion gear 32*a*. Gear 32*a* is mounted on an input shaft 33*a*, which is reciprocally mounted on housing 11*a* and a handle 34*a* reciprocally mounted thereon.

It should be noted in FIG. 9 that the hub of gear 32*a* has a hexagonal socket 35*a* formed on an outer side thereof in alignment with a like-shaped hexagonal socket 35*a*' defined on an inner side of handle 34*a*. A drive disengaging means 36*a* comprises a lever 37*a*, having a cam 37*a*' defined thereon, pivotally mounted on an end of shaft 33*a* by a pin. It can be seen in FIGS. 7 and 9 that a hexagonal nut portion or drive lug 38*a* formed on shaft 33*a*, normally engages hexagonal socket 35*a* of shaft 33*a* and also a hexagonal socket 35*a*' of handle 34*a* to drive intermeshing gears 31*a* and 32*a* to, in turn, rotate drum 15*a* in response to rotation of the handle.

A compression coil spring 40 is mounted on an inner end of shaft 33*a* and is disposed between a pair of washers 41, slidably mounted thereon, to normally urge disengaging means 36*a* into its engaged condition of operation. Should the operator choose to disengage the drive train to permit free-wheeling of drum 15*a* to pay-out the towline, he need only pivot lever 37*a* counterclockwise in FIG. 7 to move shaft 33*a* rightwardly against the opposed biasing force of spring 40 to disengage drive lug 38*a* of the shaft from drive socket 35*a* of gear 32*a*.

Referring to FIGS. 10 and 11, support bracket 13*a* is releasably secured to a mounting bracket 42 which may be secured at any desired location on the hull of a boat by a plurality of bolts 43 (FIG. 11). Support bracket 13*a* has a socket formed therein to receive stem 12*a* of the winch assembly and also has a pair of attachment means 44 and 45 formed on a bottom and a side thereof, respectively. As more clearly shown in FIG. 10, attachment means 44 comprises a guide bar, formed in a dovetail configuration, to slidably engage like-shaped V-guides 47 formed on the upper surface of mounting bracket 42.

Attachment means 45 is also shown in the form of a dovetail type slide bar 46, also adapted to slidably engage tapered V-guides 47 of the mounting bracket. Thus, mounting bracket 42 may be secured on the hull of a boat in either a horizontal or vertical disposition and either attachment means 44 or 45 of support bracket 13*a* may be slidably engaged within V-guide 47 to orientate winch assembly 10*a* either horizontally or vertically. If so desired, a spring-biased detent means 48 may be utilized to releasably secure support bracket 13*a* on mounting bracket 42. A similar detent means (not shown) may be employed between stem 12*a* of the winch assembly and support bracket 13*a*, if so desired.

We claim:

1. A water-ski towline winch assembly in combination with a towline having at least one float attached thereto, said winch assembly comprising:

a support member, mounting means on said support member for mounting said winch assembly on a boat, an annular drum, comprising a pair of spaced-apart inner and outer plates, rotatably mounted on said support member, said outer plate of said pair of plates being disposed furthest away from said support member and defining an unobstructed and fully exposed concavity on an outer side thereof, attachment means secured on said drum for attaching a hook of said towline thereto, drive means for selectively rotating said drum on said support member, and at least one pair of circumferentially spaced slot means formed in said outer plate for receiving said towline therein and for storing said float secured to said towline in the concavity defined on the outer side of said outer plate and between said slot means.

2. The winch assembly of claim 1 wherein said attachment means comprises a plurality of circumferentially spaced and longitudinally extending struts secured between siad plates.

3. The winch assembly of claim 1 wherein said drive means includes an output shaft, said drum having a tubular sleeve secured between said inner and outer plates and slidably mounted on said output shaft, means defined between said drum and said output shaft for preventing relative rotation therebetween, and means for releasably connecting said drum to said shaft for normally preventing relative longitudinal movement therebetween.

4. The winch assembly of claim 3 wherein the outer surfaces of said output shaft and the inner surfaces of said sleeve have polygonal cross-sections comprising said means for preventing relative rotation between said drum and said shaft.

5. The winch assembly of claim 4 wherein said means for preventing longitudinal movement of said drum relative to said output shaft comprises a detent mechanism disposed longitudinally within the confines of said sleeve.

6. The winch assembly of claim 3 wherein said drive means includes a sleeve mounted on said output shaft and stop means, defined on said sleeve, for engaging an end of the sleeve of said drum for longitudinally positioning said drum on said output shaft.

7. The winch assembly of claim 6 wherein said drive means further includes a gear formed on said sleeve.

8. The winch assembly of claim 7 further including another gear continuously meshing with said first-mentioned gear, an input shaft slidably mounted within said another gear, and means for reciprocating said input shaft between engaged and disengaged positions relative to said another gear.

9. The winch assembly of claim 1 further comprising mounting bracket means for securance to a boat, a support bracket having the support member of said winch assembly releasably attached thereto, first means for releasably attaching said support bracket at a first orientation on said mounting bracket means, and second means for attaching said support bracket at a second, different orientation on said mounting bracket means.

10. The winch assembly of claim 9 wherein said first means is defined on a bottom of said support bracket and wherein said second means is defined on a side of said support bracket.

11. The winch assembly of claim 10 wherein each of said first and second means includes a dovetail slide bar and wherein said mounting bracket means includes a V-guide adapted to receive a respective one of said slide bars therein.

12. The winch assembly of claim 10 further including detent means for releasably attaching said support bracket on said mounting bracket means.

13. In a water-ski towline winch assembly having a support member attachable on a boat, a drum rotatably mounted on said support member, a rotary input shaft, a rotary output shaft connected to said drum to rotate the same, and gear means for transmitting rotary motion of said input shaft to rotary motion of said output shaft, and disengagement means for selectively disengaging said input shaft from said gear means for permitting free-wheeling of said drum, the improvement comprising mounting bracket means for securance to a boat, a support bracket having the support member of said winch assembly releasably attached thereto, first means for releasably attaching said support bracket at a first orientation on said mounting bracket means, and second means for attaching said support bracket at a second, different orientation on said mounting bracket means.

14. The winch assembly of claim 13 wherein said first means is defined on a bottom of said support bracket and wherein said second means is defined on a side of said support bracket.

15. The winch assembly of claim 14 wherein each of said first and second means includes a dovetail slide bar and wherein said mounting bracket means includes a V-guide adapted to receive a respective one of said slide bars therein.

16. The winch assembly of claim 14 further including detent means for releasably attaching said support bracket on said mounting bracket means.

17. A water-ski towline drum for releasable attachment to a drive shaft of a water-ski towline winch assembly comprising first and second laterally spaced plates, said first plate having an unobstructed and fully exposed concavity defined on an outer side thereof, a centrally disposed tubular sleeve secured between said first and second plates, attachment means secured between said first and second plates for attaching a hook of said towline thereto, a plurality of circumferentially disposed slot means formed in the periphery of said first plate for receiving a portion of said towline therein for storing a float secured to said towline in exposed relationship within the concavity defined on an outer side of said first plate and between said slot means, and means for releasably attaching said drum to said drive shaft, including means for preventing relative rotation between the sleeve of said drum and said drive shaft, but for permitting the sleeve of said drum to slide axially on said drive shaft for selective removal therefrom.

18. The drum of claim 17 wherein each circumferentially adjacent pair of slot means are spaced to accomodate a single said float therebetween.

* * * * *